US007117793B2

(12) United States Patent
Petersen et al.

(10) Patent No.: US 7,117,793 B2
(45) Date of Patent: Oct. 10, 2006

(54) APPARATUS FOR THE TRANSPORTATION OF PRINTING SLEEVES

(75) Inventors: Godber Petersen, Augsburg (DE); Josef Göttling, Friedberg (DE); Thomas Hartmann, Mering (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 11/121,734

(22) Filed: May 3, 2005

(65) Prior Publication Data

US 2005/0257705 A1 Nov. 24, 2005

(30) Foreign Application Priority Data

May 5, 2004 (DE) ..... 10 2004 022 182

(51) Int. Cl.
*B41F 13/44* (2006.01)
*B65D 19/00* (2006.01)

(52) U.S. Cl. ..... 101/477; 101/216; 101/479; 414/331.05; 414/331.14

(58) Field of Classification Search ..... 101/477, 101/216, 217, 375, 376, 479, 480, 485; 414/495, 414/608, 331.14, 331.11, 331.02, 331.03, 414/331.04, 331.05, 331.06, 331.08
See application file for complete search history.

(56) References Cited

U.S. PATENT DOCUMENTS 5,188,027 A * 2/1993 Fantoni ..... 101/216
6,918,732 B1 * 7/2005 Jendroska et al. ..... 414/331.14
2005/0139109 A1 * 6/2005 Plasswich et al. ..... 101/477

FOREIGN PATENT DOCUMENTS

DE 20019273 U1 * 3/2001
WO WO 2006013046 A1 * 2/2006

* cited by examiner

*Primary Examiner*—Leslie J. Evanisko
(74) *Attorney, Agent, or Firm*—Leydig, Voit & Mayer, Ltd

(57) ABSTRACT

An apparatus for transporting printing sleeves is provided. The transport apparatus includes a housing with a bottom wall, a plurality of side walls, and at least one cover. A plurality of reception devices are mounted in the housing. Each reception device receives a printing sleeve in a vertically oriented transport position with a longitudinal mid-axes of the respective printing sleeve extending vertically. Each reception device is movable out of the housing into an outside position when the at least one cover of the housing is open. Each reception device is pivotable in the outside position such that the corresponding printing sleeve can be moved out of the vertical transport position into a horizontal extraction or insertion position.

9 Claims, 8 Drawing Sheets

APPARATUS FOR THE TRANSPORTATION OF PRINTING SLEEVES

FIELD OF THE INVENTION

The invention relates to an apparatus for the transportation of printing sleeves.

BACKGROUND OF THE INVENTION

With printed technology, the current practice is to position what may be referred to as printing sleeves on impression cylinders of a printing machine. These printing sleeves allow a smooth and jolt-free rolling of the cylinders of a printing machine that are involved in printing. Where printing machines of variable format are concerned, two printing sleeves are positioned one above the other on the impression cylinders. An outer printing sleeve forms a printing surface and an inner printing sleeves serving for diameter compensation between the outer printing sleeve and the respective impression cylinder of the printing machine. In this case, an outer printing sleeve forming a printing surface usually has a small wall thickness, whereas the inner printing sleeve serving for diameter compensation between the outer printing sleeve and the respective impression cylinder has a greater wall thickness, depending on the difference in diameter between the respective impression cylinder and the outer printing sleeve.

When carrying out a production change between two different printing orders, it is necessary to change at least the outer printing sleeve forming the printing surface. In the case of a production change between two printing orders that are characterized by the same printing format, only the outer printing sleeve has to be changed. If, however, the two printing orders also differ from one another in terms of their printing format, then the inner printing sleeve also has to be exchanged in addition to the outer printing sleeve.

During the production change, new printing sleeves must be moved up to the printing units of the printing machine and old or spent printing sleeves must be moved away from the printing machine. The movement of the printing sleeves towards and away from the printing machine takes place via corresponding printing sleeve transport apparatuses.

A change station for sleeves of printing machines is disclosed in DE 101 12 522 C2. The change station includes a lifting platform and a carriage. Avertically adjustable shelf with carrying mandrels for receiving the sleeves is mounted vertically displaceably in the carriage. The carrying mandrels for receiving the sleeves are set up in such a way that the sleeves are mounted and transported in the carriage in a horizontal position, i.e. with their longitudinal mid-axis running horizontally. Such a horizontal mounting of the sleeves may lead to a deformation of the sleeves, particularly when the horizontal mounting takes place for a lengthy period of time. This is undesirable. Furthermore, the carriage according to DE 101 12 522 C2 has greatly restricted functionality.

BRIEF SUMMARY OF THE INVENTION

In view of the foregoing, a general object of the present invention is to provide an improved apparatus for the transportation of printing sleeves. The apparatus for the transportation of printing sleeves according to the invention includes a housing having a bottom wall, a plurality of side walls and at least one cover. The apparatus of the invention further includes a plurality of reception devices for receiving in each case at least one printing sleeve that is mounted in the housing. Each reception device receiving, in a basic position or transport position, the printing sleeve in a vertical position, i.e. with the longitudinal mid-axes of the printing sleeves running vertically. With a cover open, the reception devices are movable out of the housing. In a position out of the housing, the reception devices are pivotable in such a way that each printing sleeve can be transferred out of the vertical transport position into a horizontal extraction or insertion position.

The apparatus for transporting printing sleeves of the present invention enables the printing sleeves to be mounted in a vertical orientation in a transport position. Undesirable deformations of the printing sleeves can thereby be avoided. For loading and unloading the apparatus of the invention, the reception devices on which the printing sleeves are mounted can be moved upwards out of the apparatus housing. In this moved-out position, the reception devices can be pivoted in such a way that the printing sleeves or the reception devices have a horizontally running extraction or insertion position.

According to an advantageous development of the invention, the reception devices for receiving the printing sleeves are mounted on a stand. All the reception devices are movable jointly out of the housing as a result of the movement of the stand. However, each reception device is mounted individually pivotably on the stand.

BRIEF DESCRIPTION OF THE SEVERAL VIEWS OF THE DRAWING(S)

DETAILED DESCRIPTION OF THE INVENTION

Figure 1:
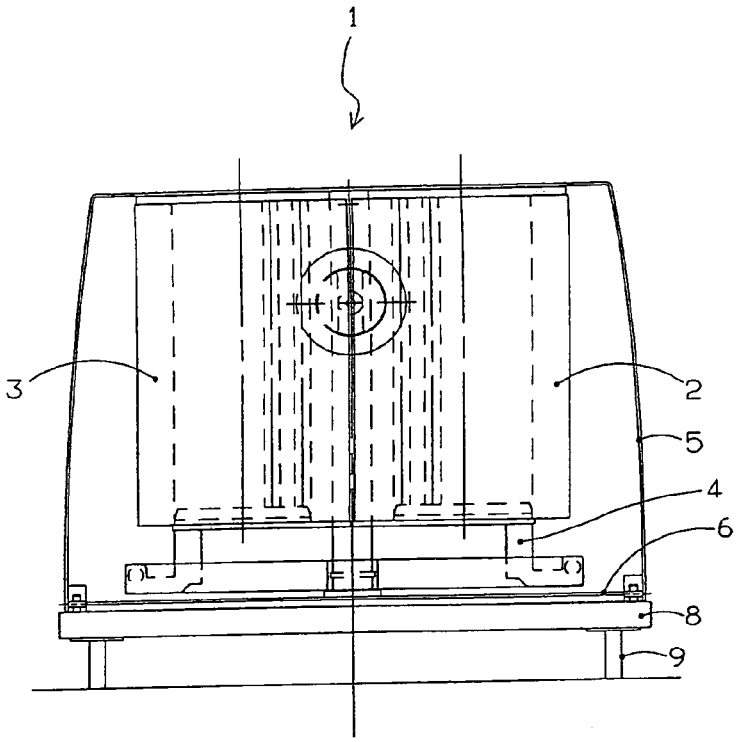
FIG. 1 is a side view of an exemplary apparatus for transporting printing sleeves according to the present invention.

Referring now to FIG. 1 of the drawings, an exemplary apparatus for transporting printing sleeves according to the invention is referenced generally in the drawings with the reference number 1. In the following description this apparatus is also referred to as a transport apparatus 1. The transport apparatus 1 of the invention includes a housing 5. The housing 5 is delimited by a bottom wall 6 and a plurality of side walls 12. On a top side of the transport apparatus 1, the housing is closed by a plurality of covers 10 (see FIG. 3), a further cover 11 being assigned to a side wall 12.

Figure 2:
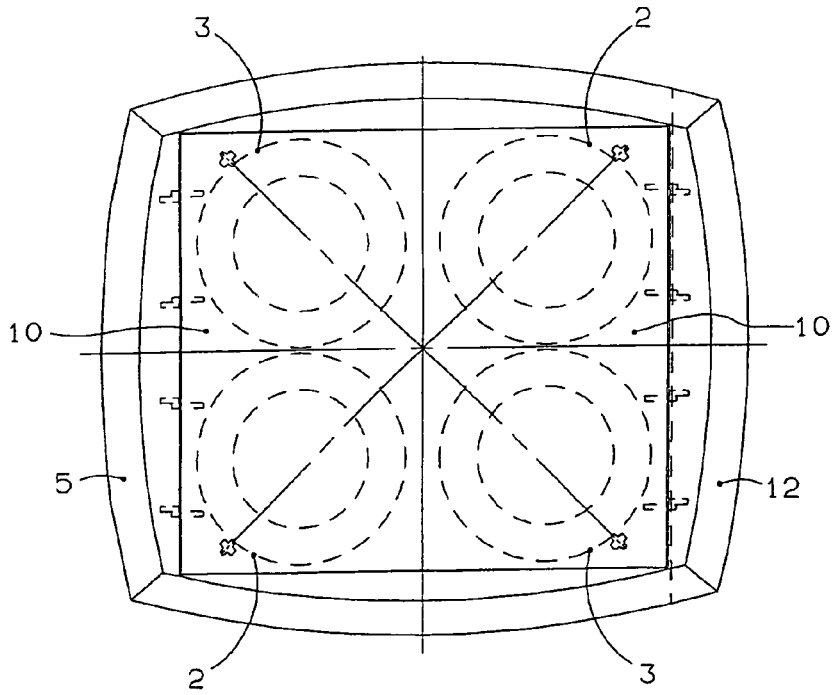
FIG. 2 is a top view of the printing sleeve transporting apparatus of FIG. 1.

A plurality of reception devices 4 for receiving printing sleeves 2 and 3, in particular form sleeves 2 and transfer sleeves 3, are arranged in the housing 5 of the transport apparatus 1. As particularly shown in FIG. 2, the illustrated transport apparatus 1 has, overall, four reception devices for receiving two form sleeves 2 and two transfer sleeves 3. In conventional web-fed printing machines in which a print carrier is printed on both sides in series-connected printing units, such an arrangement corresponds exactly to the requirements of a double printing unit.

The bottom wall 6 of the housing 5 is rotatably mounted on a bottom plate 8 of the transport apparatus 1. The bottom plate 8 stands on a floor of a workshop via feet 9 or rollers. The bottom wall 6 of the housing 5 is supported on the bottom plate 8 of the transport apparatus 1 via rollers 18 (see FIG. 4). The bottom wall 6 is rotatably mounted on the bottom plate 8 via a rotary bearing 7 (see FIG. 3). As a result, the entire housing 5, together with the reception devices 4 mounted in the housing 5, is rotatable with respect to the bottom plate 8 about a vertically extending axis. This is illustrated in FIG. 5 by a double arrow 17.

The reception devices 4 for the printing sleeves 2 and 3 are mounted on a stand 22 (see FIG. 4) that extends in a horizontal direction. All of the reception devices 4 can be moved jointly out of the housing 5 into the position numbered 22' as a result of the movement of the stand 22. However, each reception device 4 is pivotably mounted individually on the stand 22, in this case via rotary bearings 21. As particularly shown in FIG. 4, the printing sleeves identified by reference numerals 2 and 3 in the basic position and transport position can therefore be moved out of the housing 5 as a result of the joint movement of the stand 22 into the positions identified by the reference numerals 2' and 3'. Subsequently, as a result of the pivoting of the printing sleeves, the printing sleeves can be transferred into the extraction or insertion position identified by the reference numerals 2" and 3".

In the positions identified by the reference numerals 2, 3, 2' and 3', the printing sleeves are oriented with their longitudinal mid-axes extending vertically. In the positions identified by the reference numerals 2" and 3" (i.e., the extraction position and insertion position), the longitudinal mid-axes of the printing sleeves extend in a horizontal direction. The corresponding positions of the reception devices are identified by the reference numerals 4, 4' and 4".

Figure 3:
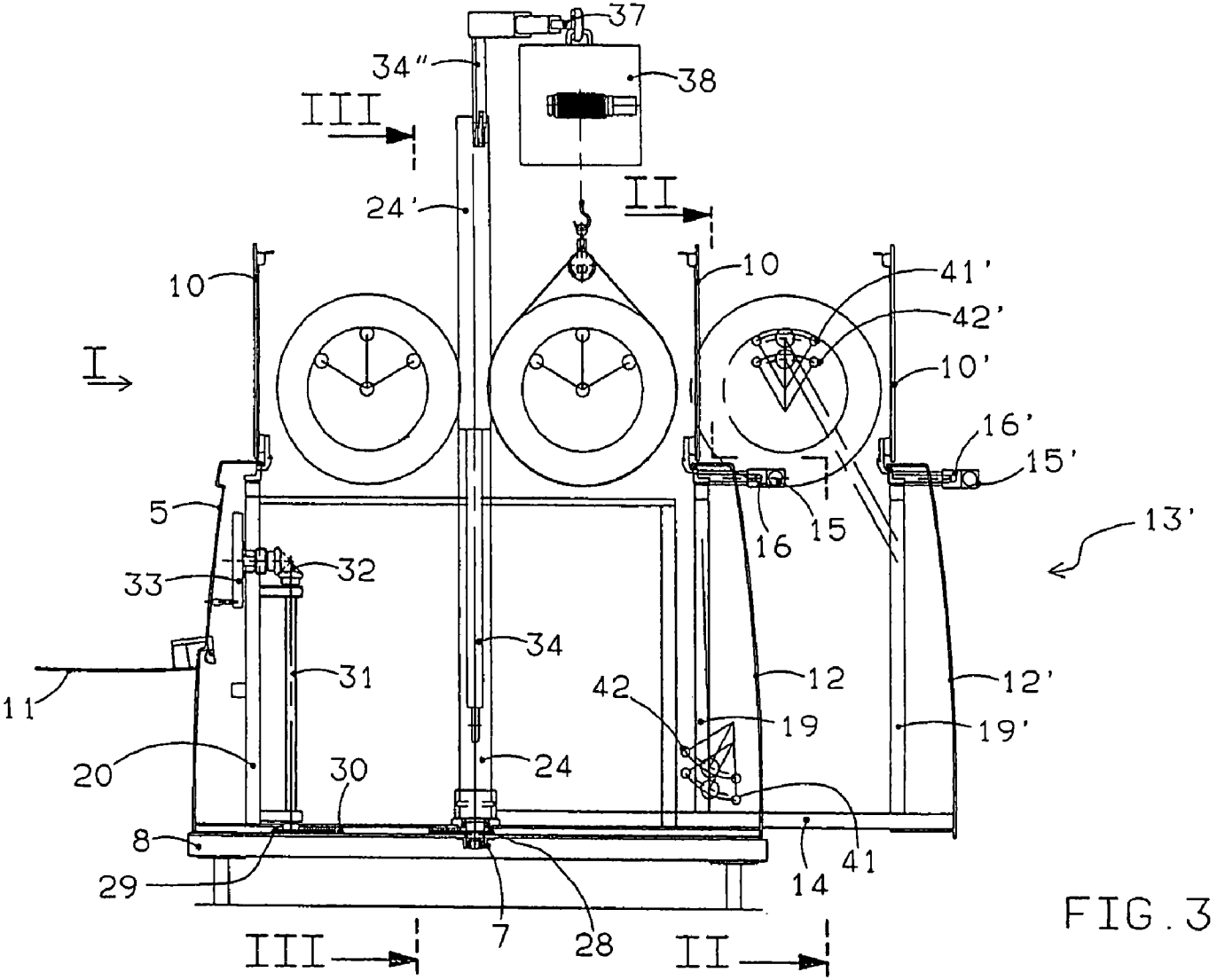
FIG. 3 is a side view of the printing sleeve transporting apparatus of FIG. 1 in an open position in several different states.
Figure 4:
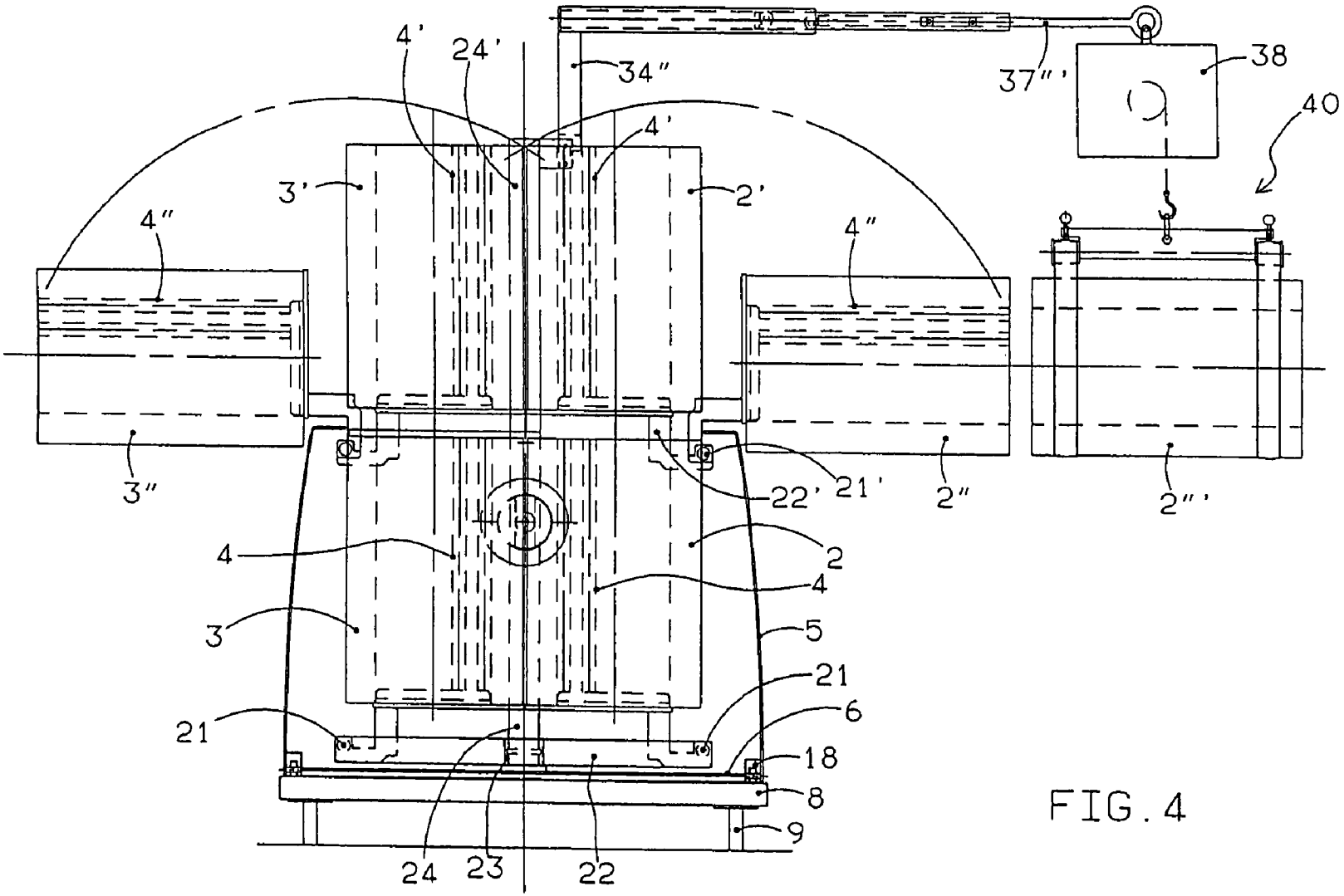
FIG. 4 is a front view of the printing sleeve transporting apparatus of FIG. 1 in the viewing direction I of FIG. 3.
Figure 5:
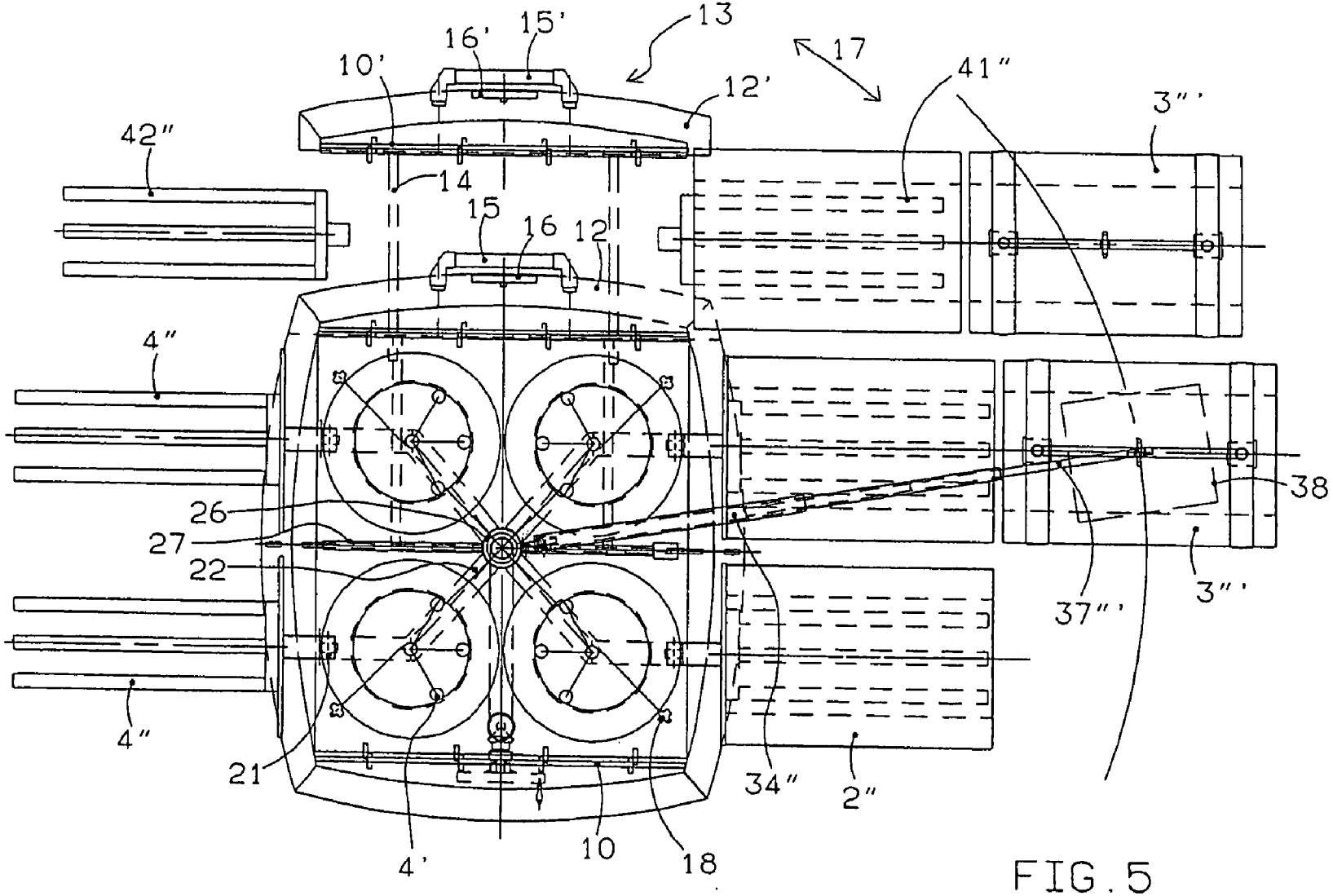
FIG. 5 is a top view of the printing sleeve transporting apparatus of FIG. 1.
Figure 7:
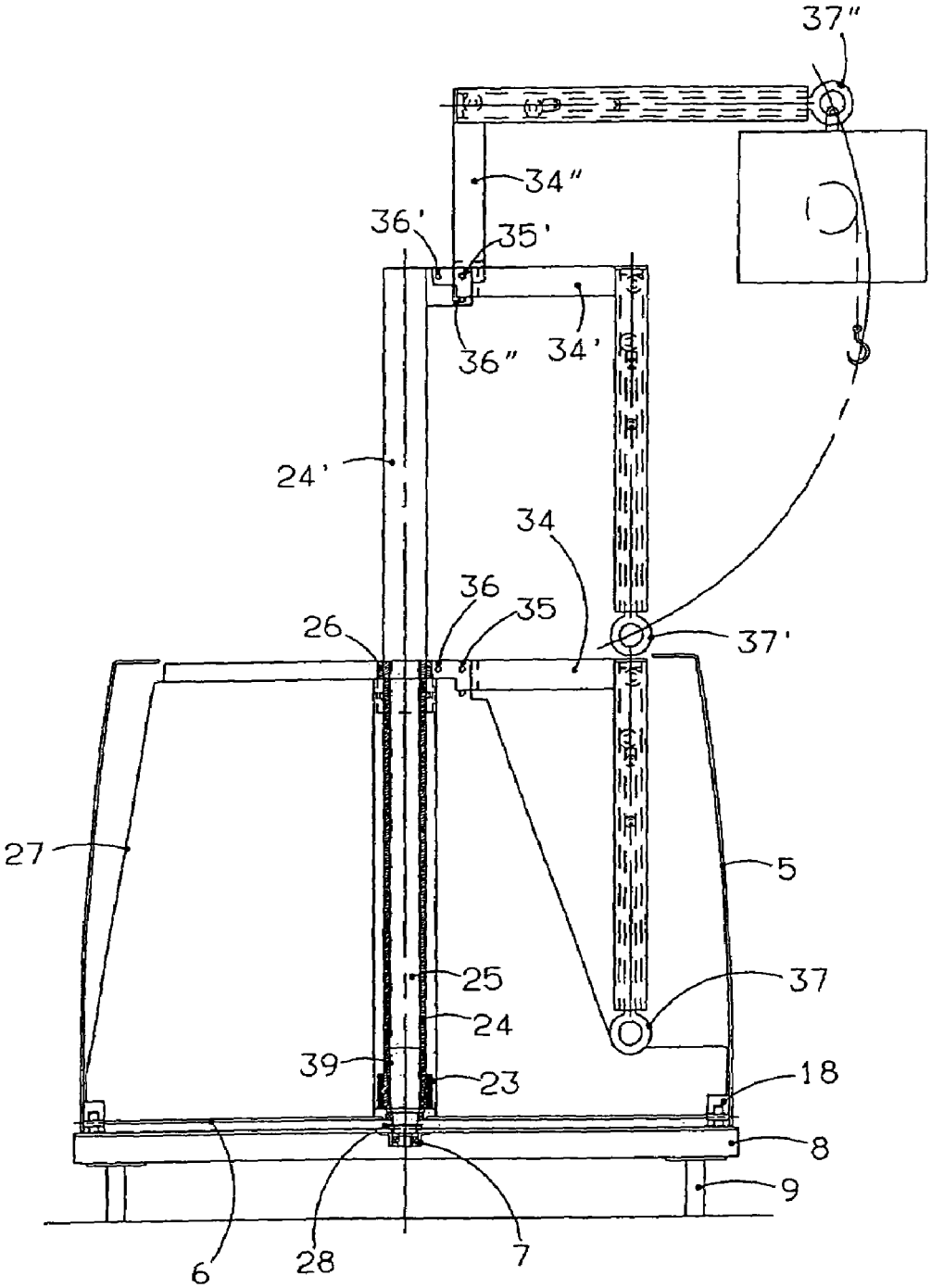
FIG. 7 is a cross-sectional view of the printing sleeve transporting apparatus of FIG. 1 taken in the plane of line III—III of FIG. 3.

The stand 22 on which the reception devices 4 are mounted is mounted in an axially fixed and radially rotatable manner to a vertically extending tube 24 via a slide bush 23 (see FIGS. 4 and 7). The vertically extending tube 24 is supported on the inside by a preferably self-locking threaded spindle 25 (see FIG. 7) and on the outside by a vertically extending stand part 27 via a slide bush 26. The stand part 27 is fixedly connected to the bottom wall 6 of the housing 5 of the transport apparatus 1. The threaded spindle 25 can be driven via a chain drive including chain wheels 28, 29 and a chain 30. As shown in FIG. 3, a shaft 31 acts on the chain drive. The shaft 31 is itself driven via a handwheel 33 and bevel wheels 32. As a result of the actuation (i.e., rotation) of the handwheel 33, the threaded spindle 25 can be moved via the bevel wheels 32. The shaft 31 and the chain drive, in this case the tube 24, are raised via a lower nut part 39 (see FIG. 7), thereby ultimately causing the stand 22 to be moved vertically.

As shown in FIGS. 3 and 5, a side wall 12 of the housing 5 is designed as a movable pull-out 13. To this end, the corresponding side wall 12 is movably mounted on the bottom wall 6 of the housing 5 via rails 14. As shown in FIG. 3, the cladding parts forming the side walls 12 are connected to the bottom plate 8 via stands 19 and 20.

Figure 6:
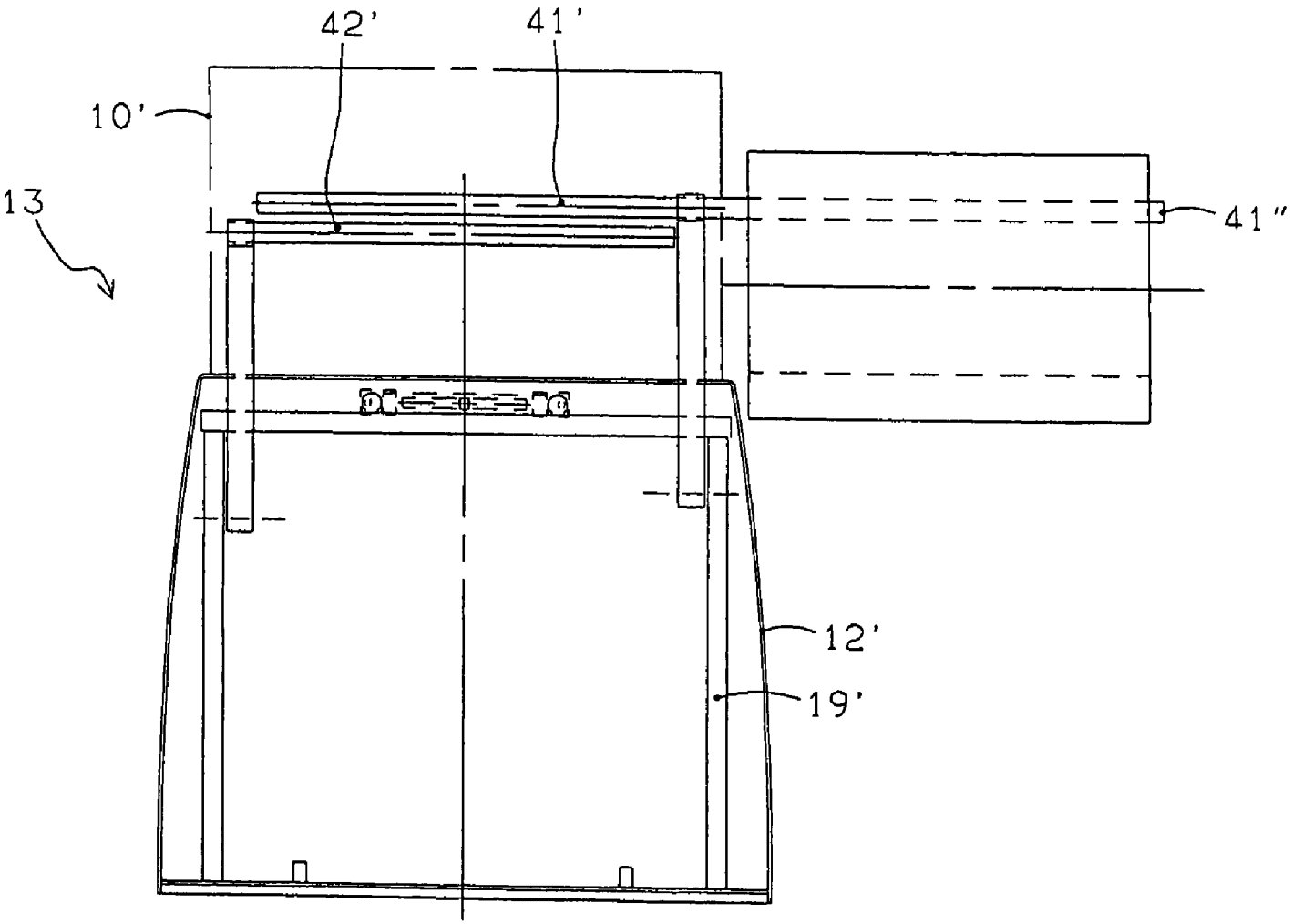
FIG. 6 is a cross-sectional view of the printing sleeve transporting apparatus of FIG. 1 taken in the plane of line II—II of FIG. 3.

FIG. 3, like FIG. 5, shows the side wall 12 configured as a pull-out 13, in two different positions, i.e. a retracted position 13 or 12 and an extended position 13' or 12'. The side wall 12 configured as a pull-out 13 is actuated via a grip 15 and an interlock 16. The rotation or pivoting of the housing 5 of the transport apparatus 1 according to the double arrow 17 shown in FIG. 5 that is described above is also made possible by the actuation of the grip 15 and of the interlock 16. As a result of the movement of the pull-out 13 into the position identified by the reference numeral 13' (see, in particular, FIG. 3), depositories 41 and 42 can be moved into the positions identified by the reference numerals 41' and 42'. As a result of the pivoting movement, the depositories can be moved into the positions identified in FIGS. 5 and 6 by the reference numerals 41" and 42".

As shown in FIGS. 3 and 4, the transport apparatus 1 has a lifting device. The lifting device is formed by a telescopic arm 37. The telescopic arm 37 is fastened at one end to the tube 24 via a holding device 34. As shown in FIG. 7, the holding device 34 is fastened in an articulated manner to the tube 24 at the centre of rotation 35, so that the holding device 34 or the telescopic arm 37 can be pivoted out of the position identified in FIG. 7 by the reference numerals 34' and 37' into the position identified by the reference numerals 34" and 37". The holding device 34 can be fixed in these positions via latching pins 36. A winch 38 engages on a free end of the telescopic arm 37. The winch 38 has a suspension device 40 fastened to it, that can be used to aid the extraction or supply of the printing sleeves 2, 3 from or to the reception devices 4. The lifting device can remain permanently fastened to the tube 24. To transfer the transport apparatus 1 into the basic position or transport position, demounting the winch 38 and pivoting the telescopic arm 37 downwards is all that is necessary. When the tube 24 is moved into the basic position or transport position, the telescopic arm 37 is then accommodated between two adjacent reception devices 4.

Figure 8:
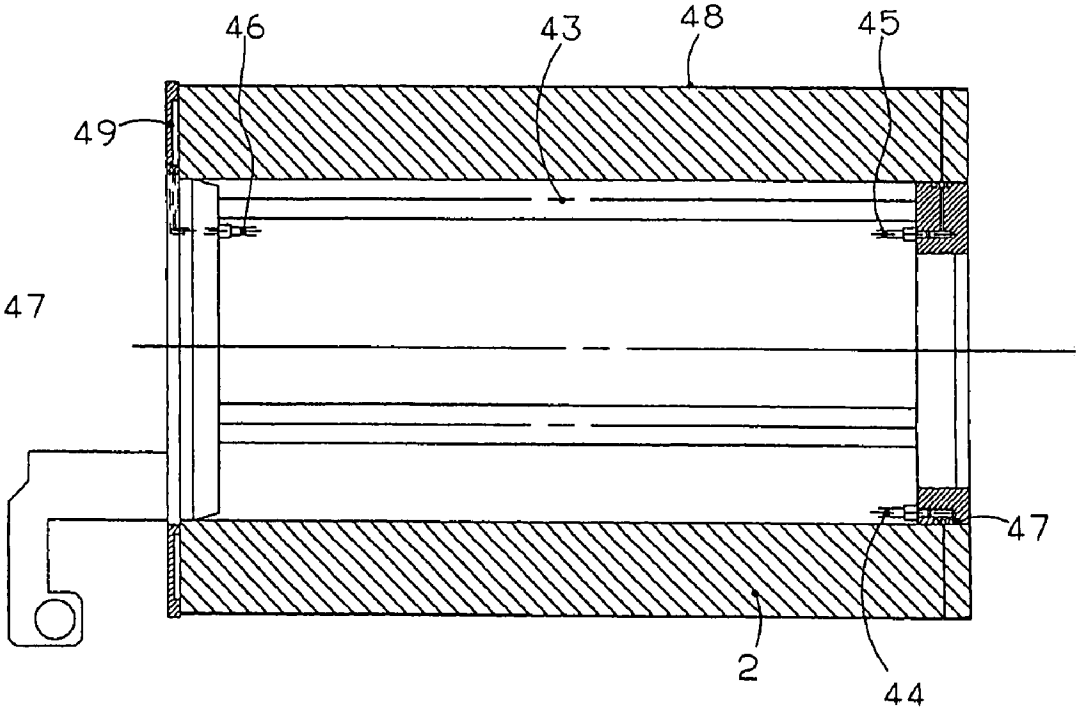
FIG. 8 is a side view of a detail of the printing sleeve transporting apparatus of FIG. 1.
Figure 9:
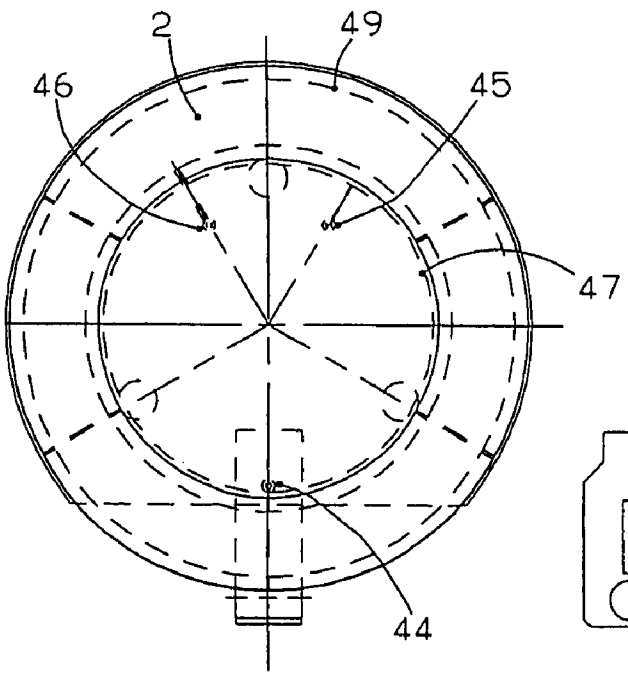
FIG. 9 is a front view of the detail of FIG. 8.

In the embodiment illustrated in FIGS. 1 to 7, the reception devices 4 are designed as rod-shaped or fork-shaped depositories. An alternatively configured reception device 43 in which compressed-air devices 44, 45 and 46 are integrated into the reception device 43 is shown in FIGS. 8 and 9. With the aid of a reception device 43 of this type, two printing sleeves, for example an outer printing sleeve 48 forming a printing surface and an inner printing sleeve 2 providing diameter compensation between the outer printing sleeve 48 and an impression cylinder, can be assembled to form a unit as early as in the region of the transport apparatus 1. In such a case, the inner printing sleeve 2 is first positioned on the reception device 43, and a seal 47 is pressed against an inner wall of the printing sleeve 2 using the compressed-air devices 44 and 45. Furthermore, a vacuum is generated in the region of a chamber 49 with the aid of the compressed-air device 46. The inner printing sleeve 2 is thereby fixed on the reception device 43. Subsequently, compressed air can be pressed through bores of the inner printing sleeve 2 with the aid of the compressed-air devices 44 and 45, in order to thereby generate an air film on an outer wall of the inner printing sleeve 2 and make it easier for the outer printing sleeve 48 to be pushed on. With the aid of the reception device 43 of FIGS. 8 and 9, printing sleeves can be prepared for installation on the printing machine outside the printing machine. This reduces the time for converting the printing units of the printing machine and consequently reduces the production downtime of the printing machine.

Figure 10:
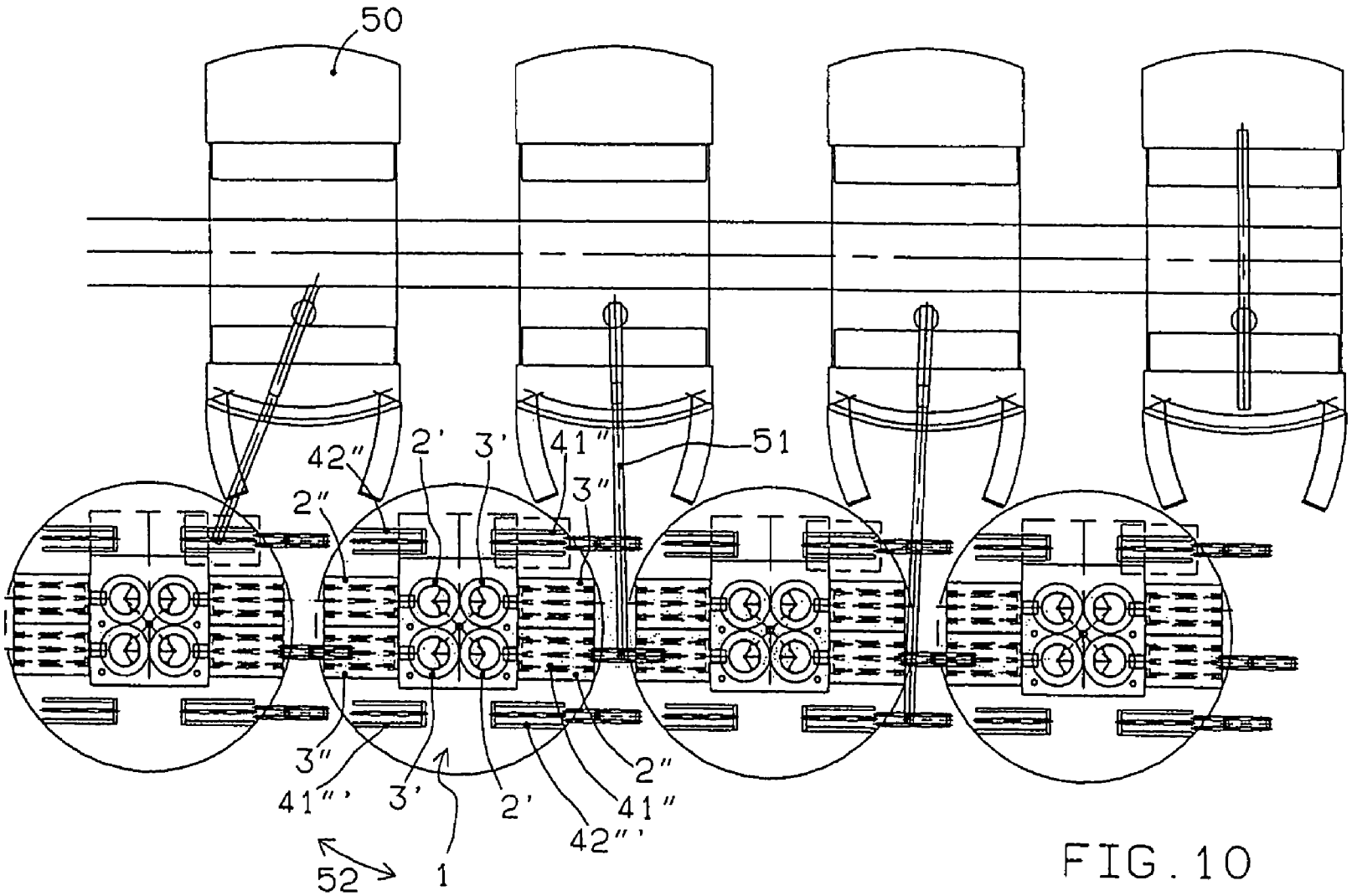
FIG. 10 is a schematic view of an exemplary printing machine showing several printing sleeve transporting apparatuses together with several printing units.

A configuration for carrying out a printing-sleeve change on a total of four printing units 50 of a printing machine is illustrated in FIG. 10. In this case, a transport apparatus 1 according to the invention is brought into the area of each of the printing units 50. The number of printing sleeves received by the transport apparatus 1 corresponds to the requirement of the respective printing unit 50. In the illustrated embodiment, for each transport apparatus 1, two form sleeves 2 and two transfer sleeves 3 are received in the transport apparatus 1. After the covers 10 and 11 of the housing 5 have been swung open, the printing sleeves can be brought into the positions 2' and 3" as a result of the actuation of the handwheel 33 and can subsequently be brought into the positions 2" and 3" as a result of the pivoting of the reception devices 4. With the aid of lifting devices 51 assigned to the printing units 50, the printing sleeves can then be extracted from the transport apparatus 1 and can be supplied to the cylinders of the printing units 50.

In detail, the procedure is that an old or spent printing sleeve is first extracted from the printing units 50 and is deposited in the region of the depository 41'. Then, a first pair of printing sleeves 2 and 3 is brought into the positions 2" and 3", respectively. The other pair of printing sleeves remains in the positions 2' and 3', so that access to the printing units 50 is ensured. After the exchange of the first pair of printing sleeves, these are swung back into the positions 2' and 3', and the transport apparatus 1 is then rotated through approximately 180° with the aid of the grip 15 after the release of the interlock 16, so that the next pair of printing sleeves can be swung out in the direction of the lifting device 51. This pivoting movement through approximately 180° is illustrated in FIG. 10 by a double arrow 52. After the exchange of printing sleeves is completed, these are swung back and moved into the transport apparatus 1 and the covers are closed. Consequently, the printing sleeves are mounted, protected against dust and protected against light, in a vertical orientation and can either remain in the transport apparatus 1 or be supplied to a shelf system.

As will be appreciated, the handwheel 33 can be actuated either purely mechanically or with electrical or pneumatic or else hydraulic assistance.

| List of Reference Symbols | |
|---|---|
| 1. | Transport apparatus |
| 2. | 2', 2", 2"' Printing sleeve |
| 3. | 3', 3", 3"' Printing sleeve |
| 4. | 4', 4" Reception device |
| 5. | Housing |
| 6. | Bottom wall |
| 7. | Rotary bearing |
| 8. | Bottom plate |
| 9. | Foot |
| 10. | 10' Cover |
| 11. | Cover |
| 12. | 12' Side wall |
| 13. | 13' Pull-out |
| 14. | Rail |
| 15. | 15' Grip |
| 16. | 16' Interlock |
| 17. | Double arrow |
| 18. | Roller |
| 19. | 19' Stand |
| 20. | Stand |
| 21. | 21' Rotary bearing |
| 22. | 22' Stand |
| 23. | Slide bush |
| 24. | 24' Tube |
| 25. | Threaded spindle |
| 26. | Slide bush |
| 27. | Stand part |
| 28. | Chain wheel |
| 29. | Chain wheel |
| 30. | Chain |
| 31. | Shaft |
| 32. | Bevel wheel |
| 33. | Handwheel |
| 34. | 34', 34" Holding device |
| 35. | Centre of rotation |
| 36. | Latching pin |
| 37. | 37', 37" Telescopic arm |
| 38. | Winch |
| 39. | Lower nut part |
| 40. | Suspension device |
| 41. | 41', 41" Depository |
| 42. | 42', 42" Depository |
| 43. | Reception device |
| 44. | Compressed-air device |
| 45. | Compressed-air device |
| 46. | Compressed-air device |
| 47. | Seal |
| 48. | Printing sleeve |
| 49. | Chamber |
| 50. | Printing unit |
| 51. | Lifting device |
| 52. | Double arrow |

The invention claimed is:

1. An apparatus for transporting printing sleeves comprising:

a housing having a bottom wall, a plurality of side walls and at least one cover; and a plurality of reception devices mounted in the housing, each reception device receiving a printing sleeve in a vertically oriented transport position with a longitudinal mid-axes of the respective printing sleeve extending vertically;

wherein each reception device is movable out of the housing into an outside position when the at least one cover of the housing is open, each reception device being pivotable in the outside position such that the corresponding printing sleeve can be moved out of the vertical transport position into a horizontal extraction or insertion position.

2. The apparatus for transporting printing sleeves according to claim 1, wherein the bottom wall of the housing is rotatably mounted on a bottom plate such that the housing together with the reception devices is rotatable about a vertically extending axis.

3. The apparatus for transporting printing sleeves according to claim 2, wherein the bottom wall of the housing is supported on the bottom plate by rollers and the bottom wall is rotatably mounted on the bottom plate via a rotary bearing.

4. The apparatus for transporting printing sleeves according to claim 1, wherein the reception devices are mounted on a movable stand with all the reception devices (4) being jointly movable out of the housing through movement of the stand and each reception device being individually pivotably mounted on the stand.

5. The apparatus for transporting printing sleeves according to claim 4, wherein the stand is rotatably fastened to a vertically extending tube by a slide bush, the tube being supported on an inside by a threaded spindle and on an outside by a vertically extending stand part, the stand part being fastened to the bottom wall of the housing, and the threaded spindle being drivable via a chain drive so that the tube and consequently the stand can be moved in the vertical direction.

6. The apparatus for transporting printing sleeves according to claim 5, further including a lifting device that has a telescopic arm, the lifting device being pivotable out of a rest position in which the telescopic arm extends vertically into a working position in which the telescopic arm extends horizontally.

7. The apparatus for transporting printing sleeves according to claim 6, wherein the telescopic arm is fastened at one end to the tube in an articulated manner by a holding device.

8. The apparatus for transporting printing sleeves according to claim 6, wherein the telescopic arm carries a winch at a free end.

9. The apparatus for transporting printing sleeves according to claim 1, wherein one of the side walls of the housing is designed as a movable pull-out that is mounted on the bottom wall via rails.

* * * * *